US009795192B2

(12) United States Patent
Huang

(10) Patent No.: US 9,795,192 B2
(45) Date of Patent: Oct. 24, 2017

(54) BUCKLE

(71) Applicant: WUJAY INDUSTRIES CO., LTD, New Taipei (TW)

(72) Inventor: Ko-Ping Huang, New Taipei (TW)

(73) Assignee: WUJAY INDUSTRIES CO., LTD., New Taipei (TW)

( * ) Notice: Subject to any disclaimer, the term of this patent is extended or adjusted under 35 U.S.C. 154(b) by 0 days.

(21) Appl. No.: 15/267,078

(22) Filed: Sep. 15, 2016

(65) Prior Publication Data

US 2017/0079383 A1 Mar. 23, 2017

(30) Foreign Application Priority Data

Sep. 18, 2015 (TW) ..... 104130901 A

(51) Int. Cl.
*A44B 11/26* (2006.01)
*A44B 11/25* (2006.01)

(52) U.S. Cl.
CPC ..... *A44B 11/266* (2013.01); *A44B 11/2592* (2013.01)

(58) Field of Classification Search
CPC ..... A44B 11/266; A44B 11/2592; Y10T 24/45524; Y10T 24/45529; Y10T 24/45581; Y10T 24/45482
See application file for complete search history.

(56) References Cited

U.S. PATENT DOCUMENTS 5,311,649 A * 5/1994 Suh ..... A44B 11/266 24/616
5,546,642 A 8/1996 Anscher
6,560,830 B1 * 5/2003 Chi ..... A44B 11/266 24/616
8,720,018 B2 * 5/2014 Yoshie ..... A44B 11/266 24/615

(Continued)

FOREIGN PATENT DOCUMENTS

TW M504159 U 7/2015
TW M508607 U 9/2015

OTHER PUBLICATIONS

TW Office Action dated Jul. 25, 2016 as received in Application No. 104130901(English Translation).

(Continued)

*Primary Examiner* — Robert J Sandy
*Assistant Examiner* — Rowland Do
(74) *Attorney, Agent, or Firm* — Maschoff Brennan

(57) ABSTRACT

A buckle includes a female member and a male member. The female member has a cavity and two side openings located on two opposite sides of the female member and connected to the cavity. The male member is partially detachably plugged into the cavity and includes a base part, two engaging parts and a releasing part. The two engaging parts are disposed on the base part. The releasing part is disposed between and connected to the two engaging parts. Each of the engaging parts includes an engaging portion and an arm (Continued)

portion located between and connected to the engaging portion and the base part. When the releasing part is moved with respect to the base part, the engaging portions are moved close to each other by the releasing part so that the two engaging portions are respectively disengaged from the two side openings of the female member.

10 Claims, 15 Drawing Sheets

(56) References Cited

U.S. PATENT DOCUMENTS

2002/0092140 A1* 7/2002 Van Tassel ..... A44B 11/266 24/614
2006/0272136 A1* 12/2006 Chui ..... A44B 11/266 24/614
2009/0100652 A1* 4/2009 Mok ..... A44B 11/266 24/625
2011/0030180 A1* 2/2011 Parisi ..... A44B 11/2546 24/611
2011/0099776 A1* 5/2011 Anscher ..... A44B 11/266 24/629
2011/0107565 A1* 5/2011 Shen ..... A44B 11/266 24/633
2012/0124790 A1* 5/2012 Richards ..... A44B 11/2519 24/593.1
2012/0227220 A1* 9/2012 Fiedler ..... A01K 27/005 24/459
2014/0173859 A1* 6/2014 Anderson ..... A44B 11/2592 24/598.1
2015/0320148 A1* 11/2015 Bevilacqua ..... A44B 11/2592 24/634
2016/0150857 A1* 6/2016 Botkus ..... A44B 11/2592 24/615

OTHER PUBLICATIONS

TW Notice of Allowance dated Oct. 28, 2016 as received in Application No. 104130901(English Translation).

* cited by examiner

21d

21g

21h

BUCKLE

CROSS-REFERENCE TO RELATED APPLICATIONS

This non-provisional application claims priority under 35 U.S.C. §119(a) on Patent Application No(s). 104130901 filed in China on Sep. 18, 2015, the entire contents of which are hereby incorporated by reference.

TECHNICAL FIELD

The disclosure relates to a buckle, more particularly to a buckle for fastening two loose ends.

BACKGROUND

Buckles are widely used, for example, in bags, protective clothing, helmets, goggles, belts, strap or other articles for daily use, the buckle can quickly fasten two ends together. In detail, a tradition buckle usually includes a female member fixed to one end of a belt or strap and a male member fixed to the other end of the same belt or to another belt, the female member has two side openings, and the male member has two movable tongues, the male member can be plugged into the female member so that the two movable tongues can be engaged into the two side openings in order to fix the male member to the female member.

Specifically, when opening the traditional buckle, the user has to use one hand to hold the male member, and use two fingers of the other hand to squeeze the movable tongues until the movable tongues are disengaged from the side openings, and then the male member can be unplugged from the female member. That is, the traditional buckle requires two hands to release the male member. In addition, it requires the user to squeeze the movable tongues very hard to open the tradition buckle, the user's fingers are easily pinched in the gaps between the movable tongues and the side openings while squeezing the movable tongues, and it is inconvenient for the user and not suitable for those infirm on their fingers.

SUMMARY

The present disclosure provides a buckle which is easy and convenient for the user to use and suitable for those infirm on their fingers.

One embodiment of the disclosure provides a buckle including a female member and a male member. The female member has a cavity and two side openings. The two side openings are respectively located on two sides of the female member opposite to each other. The two side openings are connected to the cavity. The male member is partially detachably plugged into the cavity of the female member. The male member includes a base part, two engaging parts and a releasing part. The two engaging parts are disposed on the base part and located opposite to each other. The releasing part is disposed between and connected to the two engaging parts. Each of the engaging parts includes an engaging portion and an arm portion. The arm portion is located between and connected to the engaging portion and the base part. When the releasing part is moved with respect to the base part, the two engaging portions are moved close to each other by the movement of the releasing part so that the two engaging portions are respectively disengaged from the two side openings of the female member.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION

Figure 1:
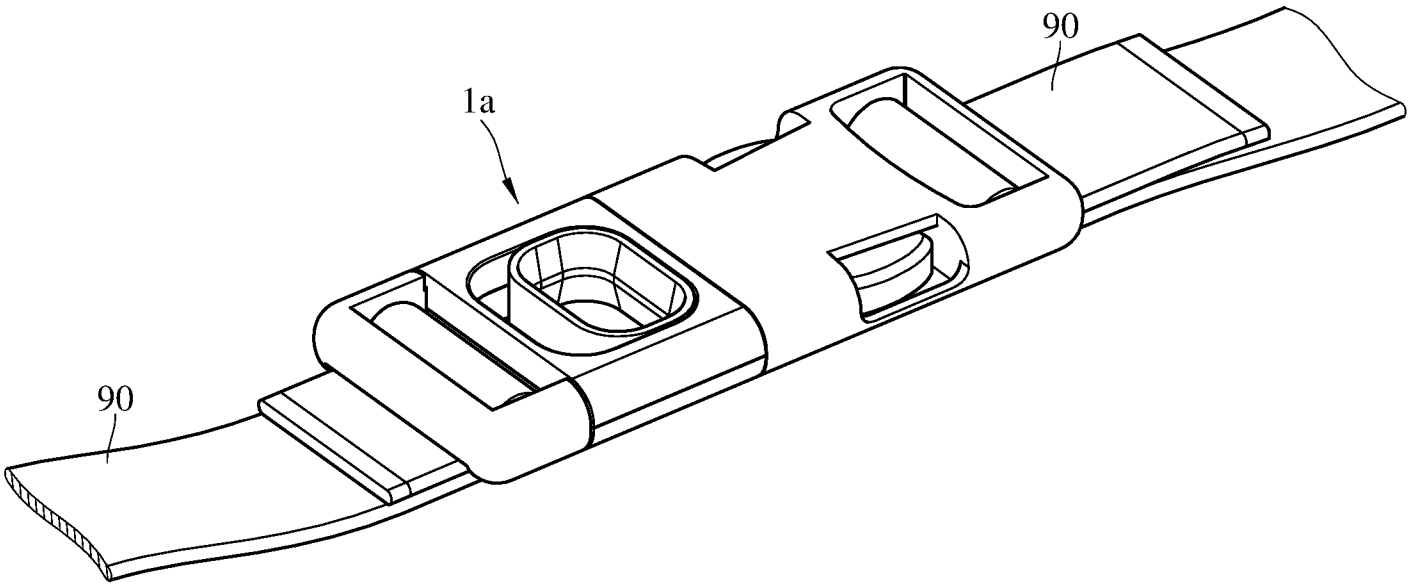
FIG. 1 is a perspective view of a buckle according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Please refer to FIG. 1, which is a perspective view of a buckle according to a first embodiment of the disclosure. As shown in FIG. 1, a buckle 1*a*, also called side release buckle, is provided. The buckle 1*a* is able to detachably connect two belts or straps 90.

Figure 2:
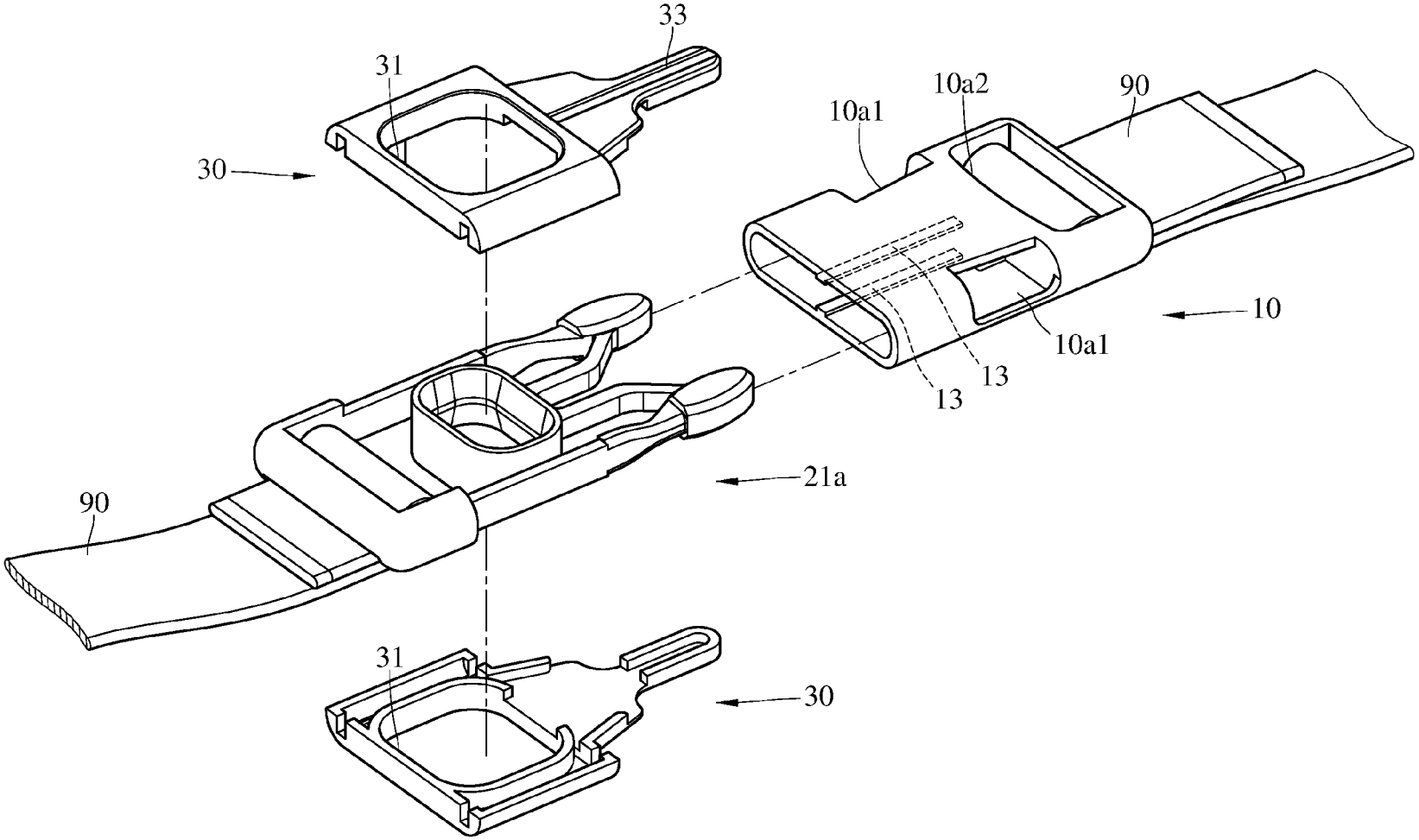
FIG. 2 is an exploded view of the buckle in FIG. 1.
Figure 3:
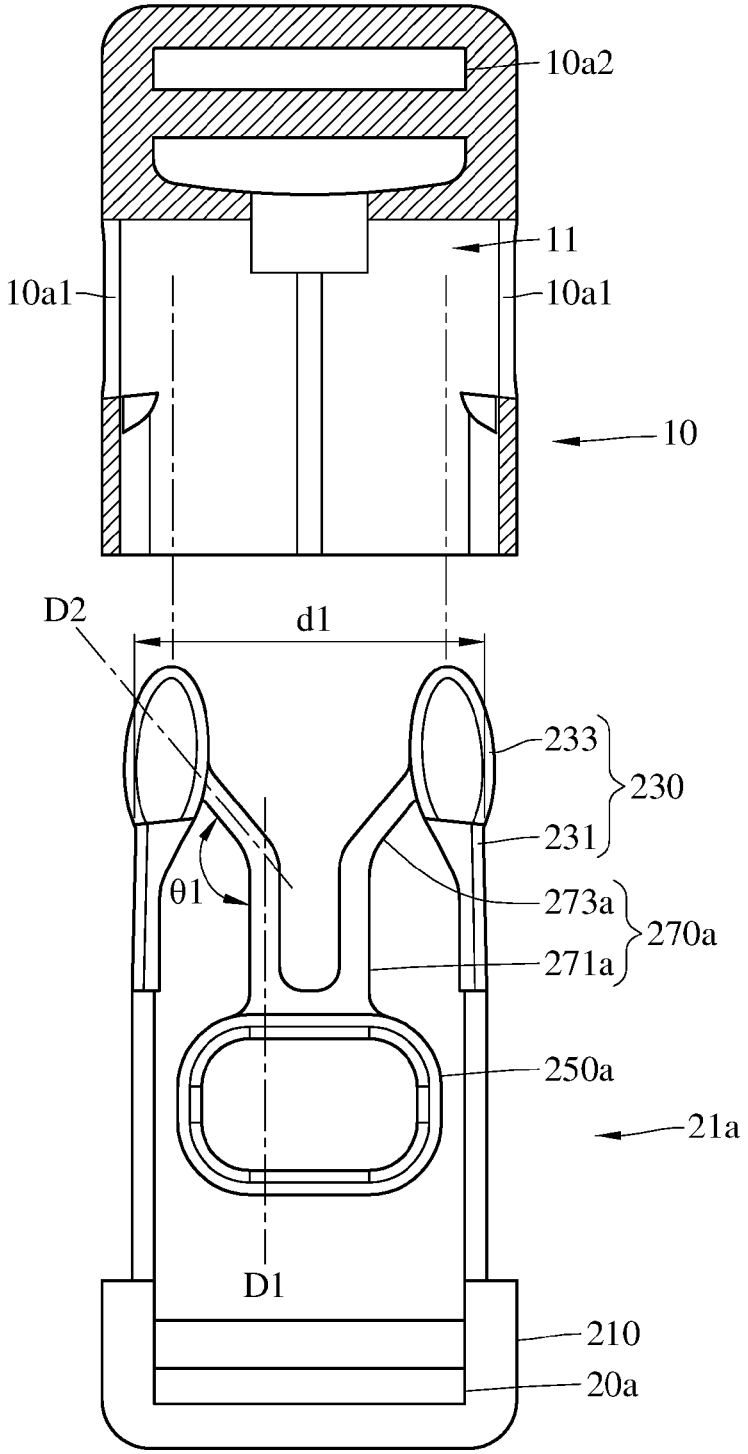
FIG. 3 is a top view of a male member and a female member in FIG. 2.

Then, the details of the buckle 1*a* are discussed in the following paragraphs. Please refer to FIGS. 2-3, FIG. 2 is an exploded view of the buckle in FIG. 1, and FIG. 3 is a top view of a male member and a female member in FIG. 2.

The buckle 1*a* includes a female member 10, a male member 21*a* and two covers 30. For the purpose of better illustrating the other portions of the buckle 1*a*, the covers 30 and the belts 90 are omitted, and the female member 10 is illustrated in a cross-sectional view.

The female member 10, also called a receptacle, has two side openings 10*a*1, a first slot 10*a*2 and a cavity 11. The first slot 10*a*2 is located on a side of the female member 10 and configured to dispose the belt 90. The cavity 11 is formed in the female member 10. The two side openings 10*a*1 are located on two sides of the female member 10 opposite to each other, and the two side openings 10*a*1 are connected to the cavity 11.

The male member 21*a*, also called a plug, is partially detachably plugged into the cavity 11 of the female member 10. Specifically, the male member 21*a* includes a base part 210, two engaging parts 230, a releasing part 250*a* and two connection parts 270*a*.

The male member 21*a* has a second slot 20*a* located on the base part 210 and configured to dispose the same or the other belt 90. The two engaging parts 230 are disposed on the base part 210 and located opposite to each other. Specifically, each engaging part 230 includes an engaging portion 233 and an arm portion 231, and the arm portion 231 is located between and connected to the engaging portion 233 and the base part 210. Each of the arm portions 231 is a resiliently flexible arm structure. The two engaging portions 233 are respectively releasably engaged into the two side openings 10*a*1 of the female member 10. In addition, in this embodiment, the two engaging portions 233 are spaced apart by a distance d1. The said distance d1 means a horizontal distance between two junctions which are between the arm portions 231 and the engaging portions 233 from the viewpoint of FIG. 3.

In this embodiment, the releasing part 250*a* is a closed shaped structure, but the present disclosure is not limited thereto, the shape of the releasing part can be a circle, oval, square or polygon, or other opened ring shaped structures. The releasing part 250*a* has a through hole 250*a*1 which is big enough for a human's finger to fit in. In this embodiment, the releasing part 250*a* is connected to the two engaging parts 230 through the two connection parts 270*a*, respectively, that is, two opposite ends of the two connection parts 270*a* are respectively connected to the releasing part 250*a* and the two engaging parts 230, but the present disclosure is not limited thereto. In other embodiments, the releasing part 250*a* can be connected to the two engaging parts 230 through single structure made of textile material.

In this embodiment, each connection part 270*a* includes a first sub-connection part 271*a* connected to the releasing part 250*a* and a second sub-connection part 273*a* located between and connected to the first sub-connection part 271*a* and the engaging portion 233 of one of the engaging parts 230. Two opposite ends of the second-connection part 273*a* are respectively directly connected to the engaging portion 233 and the first sub-connection part 271*a*, but the present disclosure is not limited thereto. In other embodiments, two opposite ends of the second sub-connection part 273*a* can be respectively directly connected to the first sub-connection part 271*a* and the arm portion 231. In addition, in this embodiment, in each connection part 270*a*, an angle θ1 formed between an extension line D1 of the first sub-connection part 271*a* and an extension line D2 of the second sub-connection part 273*a* ranges between 90 degrees and 180 degrees.

Furthermore, in this embodiment, the male member 21*a* is an integral structure, that is, the base part 210, the two engaging parts 230, the releasing part 250*a* and the two connection parts 270*a* are integrated into one piece, but the present disclosure is not limited thereto.

The two covers 30 are detachably disposed on two opposite sides of the male member 21*a*, that is, the male member 21*a* is located between the two covers 30. In this embodiment, each cover 30 has a guiding groove 31 so that the releasing part 250*a* of the male member 21*a* is movably located in the two guiding grooves 31 of the two covers 30, the guiding grooves 31 form a path for the movement of the releasing part 250*a* in order to prevent the releasing part 250*a* from moving to undesired direction.

Figure 4:
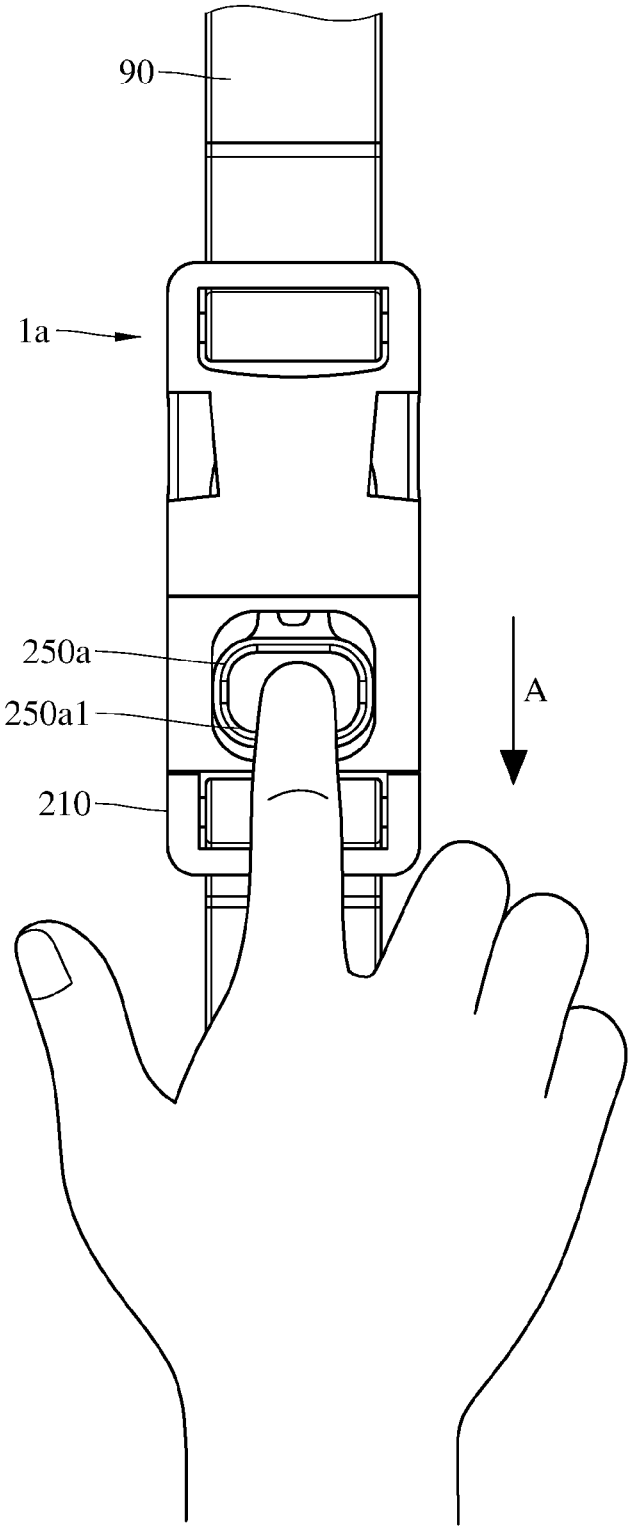
FIG. 4 is a diagram showing the operation of the buckle in FIG. 1.
Figure 5:
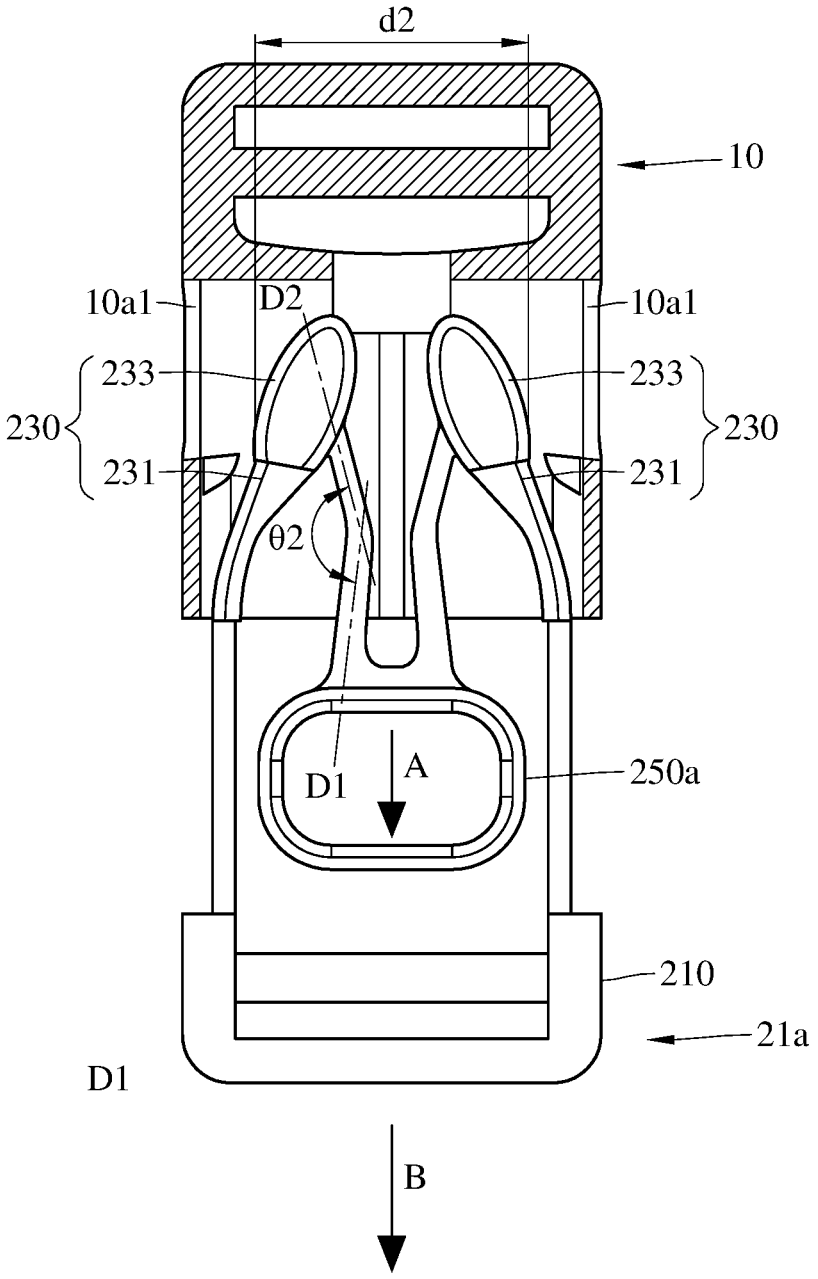
FIG. 5 is a top view of the male member and the female member in FIG. 4.

Then, the operation of the buckle 1*a* is described in the following paragraphs. Please refer to FIGS. 4-5, FIG. 4 is a diagram showing the operation of the buckle in FIG. 1, and FIG. 5 is a the top view of the male member and the female member in FIG. 4. For the purpose of better illustrating the other portions of the buckle, in FIG. 5, the finger, the covers 30 and the belts 90 are omitted, and the female member 10 is illustrated in a cross-sectional view.

Firstly, as shown in FIG. 4, an user can put his/her finger into the through hole 250*a*1 of the releasing part 250*a* and pull the releasing part 250*a* in a pulling direction A to move the releasing part 250*a* with respect to the base part 210.

Then, in detail, as shown in FIG. 5, when the releasing part 250*a* is moved with respect to the base part 210 in the pulling direction A, the releasing part 250*a* can drive the two engaging portions 233 of the two engaging parts 230 to move close to each other via the two connection parts 270*a*. In such a case, the two arm portions 231 of the two engaging parts 230 are bent by the movement of the two engaging portions 233 so that the two engaging portions 233 can be moved close to each other and respectively disengaged from the two side openings 10*a*1 of the female member 10. At the meantime, the male member 21*a* is able to be released from the female member 10 so that the male member 21*a* is able to be unplugged from the female member 10 in an unplugging direction B.

Accordingly, it is noted that the male member 21*a* can be unplugged by using one finger to pull the releasing part 250*a*, so the operation of the buckle 1*a* of the disclosure is easy and convenient for users. In addition, in this embodiment, the direction of moving the releasing part 250*a* (e.g. the pulling direction A) is substantially the same as the direction of unplugging the male member 21*a* (e.g. unplugging direction B), that is, the direction of moving the releasing part 250*a* away from the female member 10 is consistent with the direction of unplugging the male member 21*a* from the female member 10, so the movement and the disengagement can be finished in one action. In such a case, the user can further move their arm or body to help the pulling of the releasing part 250*a* in order to reduce the effort on disengaging the male member 21*a* from the female member 10. Therefore, the buckle of the disclosure is suitable for the elderly having less strength in their fingers or those infirm on their fingers.

In addition, by comparing FIG. 3 and FIG. 5, during the movement of the releasing part 250*a*, the angle between the first sub-connection part 271*a* and the second sub-connection part 273*a* is increased from θ1 to θ2, and the distance between the two engaging portions 233 is decreased from d1 to d2. Similarly, the said angle θ2 means the angle formed between the extension line D1 of the first sub-connection part 271*a* and the extension line D2 of the second sub-connection part 273*a*, and the said distance d2 means a horizontal distance between two junctions which are between the arm portions 231 and the engaging portions 233 from the viewpoint of FIG. 5.

Please refer to Table 1, which shows operation tests of practical examples based on the configuration of the buckle in the first embodiment. It is noted that angles θ1 of these practical examples are different, but the movement of each releasing part 250*a* while testing these practical examples are the same.

TABLE 1

| angle θ1 | angle θ2 | distance d1 | distance d2 | movement of the engaging portion ((d1-d2)/2) |
|---|---|---|---|---|
| 135° | 140° | 29.30 (mm) | 22.1 (mm) | 3.6 (mm) |
| 140° | 150.3° | 29.30 (mm) | 21.4 (mm) | 3.95 (mm) |
| 145° | 155.5° | 29.30 (mm) | 20.4 (mm) | 4.45 (mm) |
| 150° | 160° | 29.30 (mm) | 19.3 (mm) | 5 (mm) |
| 155° | 162.8° | 29.30 (mm) | 23.75 (mm) | 5.38 (mm) |

As shown in Table 1, if the angle θ1 between the first sub-connection part 271*a* and the second sub-connection part 273*a* is greater, the movement of the engaging portions 233 is greater.

In this embodiment, the buckle 1*a* can be opened by pulling the releasing part 250*a*, but the present disclosure is not limited thereto. The buckle can be opened by different ways according to individual's usage habit, for example, the user still can open the buckle 1*a* by pressing the engaging portions 233 to release them from the side openings 10*a*1.

In addition, the present disclosure is not limited to the operation of the releasing part 250*a* as discussed above, the designs capable of driving the two engaging parts 230 to disengage the two engaging portions 233 from the side openings 10*a*1 fall within the scope of the present disclosure. In other embodiments, the buckle can further includes a switch (not shown), the switch can be pressed in a direction substantially perpendicular to the pulling direction A to drive the two engaging portions 233 of the two engaging parts 230 to disengage from the side openings 10*a*1.

Furthermore, please refer back to FIG. 2, the female member 10 further includes two first guide structures 13, and each cover 30 further includes a second guide structure 33. The two first guide structures 13 are located opposite to each other and located on the inner wall of the female member 10, and the second guide structure 33 is located on a side of one of the covers 30 which is opposite to the other cover 30. The two second guide structures 33 respectively correspond to the two first guide structures 13. In this embodiment, the first guide structure 13 is a protrusion, and the second guide structure 33 is a groove so that the first guide structures 13 are respectively movably located in the second guide structures 33, and thereby positioning the male member 21*a* while it is plugged into the female member 10. However, the present disclosure is not limited to the configurations of the first guide structure 13 and the second guide structure 33. In other embodiments, the first guide structure can be a groove, and the second guide structure can be a protrusion.

In addition, the covers 30 are optional, the present disclosure is not limited thereto, and the amount of the covers 30 can be altered according to actual requirements. In other embodiments, the buckle can have no cover 30, or the buckle can have only one cover 30 disposed on a side of the male member 21*a*. Accordingly, it can be understand that the first guide structure 13 of the female member 10 and the second guide structure 33 of the cover 30 are optional as well. For example, in the embodiment that the buckle has no cover 30, the first guide structure 13 and the second guide structure 33 are omitted. For another example, in the embodiment that the buckle having the cover 30, the amount of the first guide structure 13 of the female member 10 and the amount of the second guide structure 33 of the cover 30 can be altered according to actual requirements. In other embodiments, the amount of the first guide structures 13 on a side of the cavity 11 of the female member 10 and the amount of the second guide structures 33 of each cover 30 can both over two.

Furthermore, the present disclosure is not limited to the positions of the second slot 20*a*. In other embodiments that the buckle is disposed with the covers 30, the second slot 20*a* can be located on one of the covers 30.

Then, in the aforementioned embodiment, the male member 21*a* is a single piece, but the present disclosure is not limited thereto. For example, please refer to FIG. 6, which is a male member according to a second embodiment of the disclosure. In the second embodiment, only differences between the second embodiment and the first embodiment are explained because the second embodiment is similar to the first embodiment.

Figure 6:
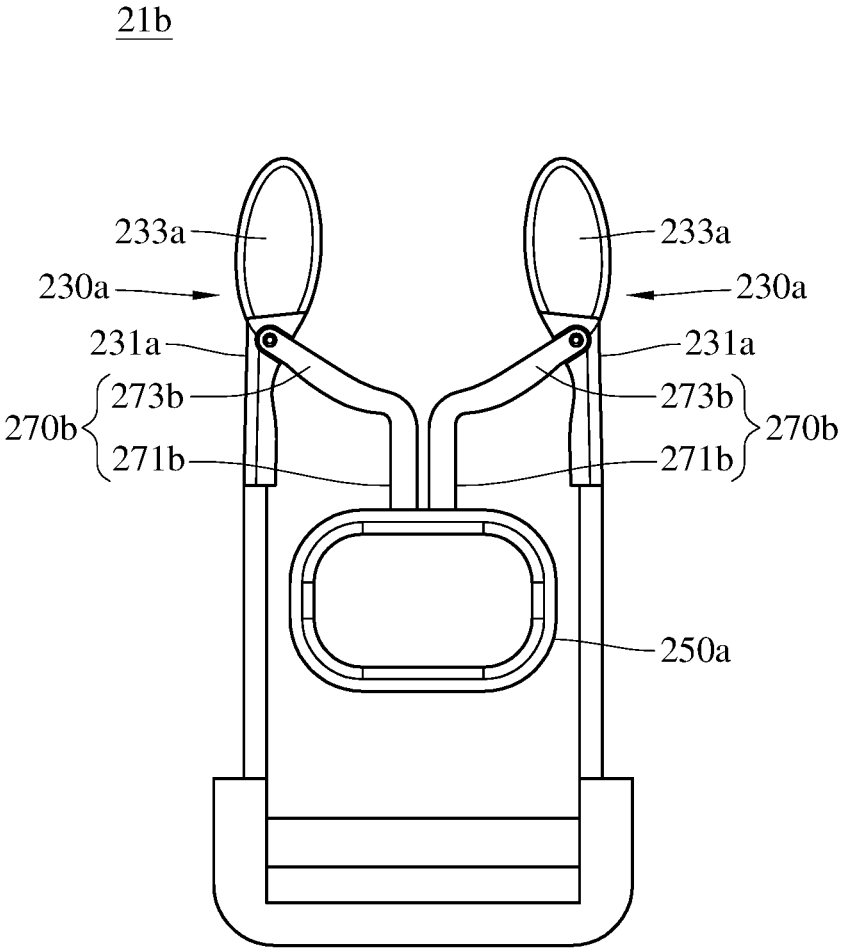
FIG. 6 is a male member according to a second embodiment of the disclosure.

As shown in FIG. 6, a male member 21*b* is provided, and it includes two engaging parts 230*a* each including an engaging portion 233*a* and an arm portion 231*a*, and two connection parts 270*b* each including a first sub-connection part 271*b* and a second sub-connection part 273*b*. The two second sub-connection parts 273*b* of the two connection parts 270*b* are respectively pivoted to the two engaging portions 233*a* of the two engaging parts 230*a*.

Figure 7A:
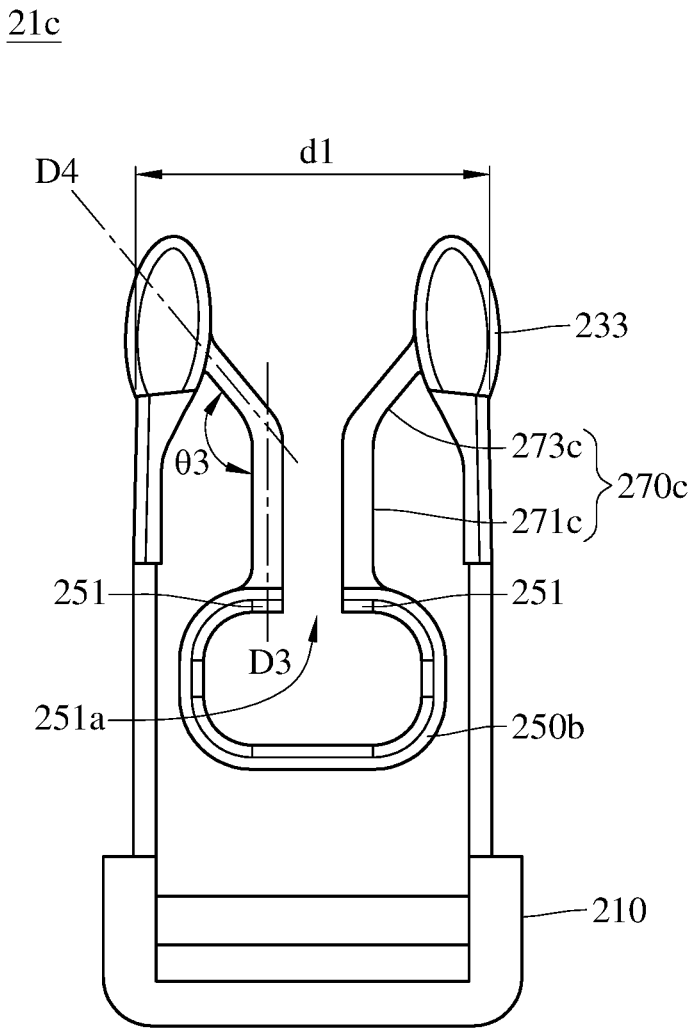
FIG. 7A is a male member according to a third embodiment of the disclosure.
Figure 7B:
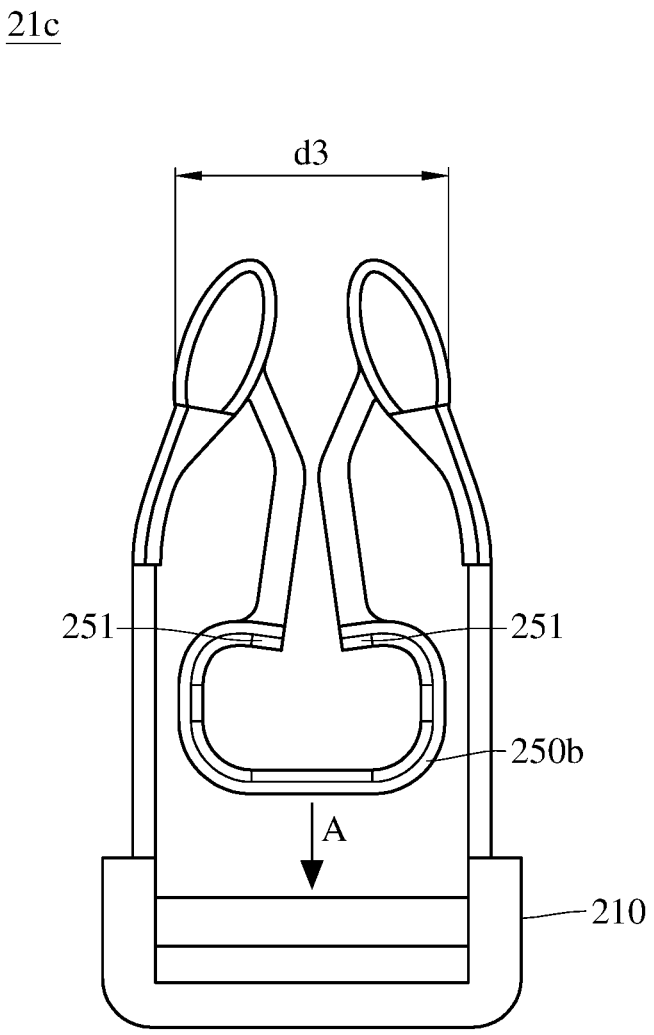
FIG. 7B is a top view of a releasing part of the male member in FIG. 7A moved with respect to a base part.
Figure 8:
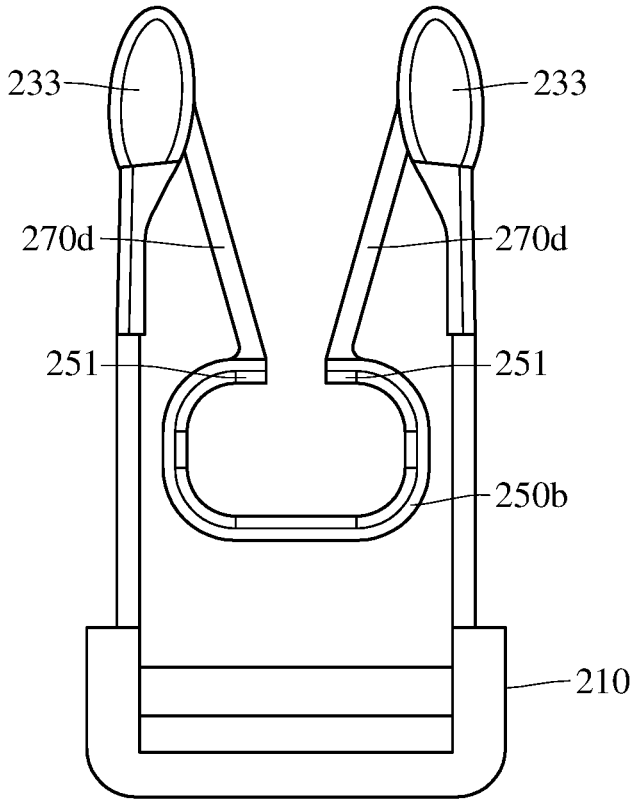
FIG. 8 is a top view of a male member of a fourth embodiment of the disclosure.

Then, in the aforementioned embodiment, the releasing part 250*a* is a closed shaped structure, but the present disclosure is not limited thereto. For example, please refer to FIGS. 7A-7B and 8, FIG. 7A is a male member according to a third embodiment of the disclosure, FIG. 7B is a top view of a releasing part of the male member in FIG. 7A moved with respect to a base part, and FIG. 8 is a top view of a male member of a fourth embodiment of the disclosure. In the third and fourth embodiments, only differences among the first, the third and fourth embodiments are explained because the third and fourth embodiments are similar to the first embodiment.

As shown in FIG. 7A, a male member 21*c* is provided, and it includes a releasing part 250*b* and two connection parts 270*c*. Each connection parts 270*c* each including a first sub-connection part 271*c* and a second sub-connection part 273*c*. The releasing part 250*b* is an opened shaped structure having two movable ends 251 and an opening 251*a* located between the two movable ends 251, the two movable ends 251 are respectively connected to the two first sub-connection parts 271*c* of the two connection parts 270*c*. It is similar to the first embodiment, when the releasing part 250*b* is not moved with respect to the base part 210, the distance between the two engaging portions 233 is d1, and in each connection part 270*c*, an angle θ3 formed between an extension line D3 of the first sub-connection part 271*c* and an extension line D4 of the second sub-connection part 273*c* ranges between 90 degrees and 180 degrees. Then, as shown in FIG. 7B, when the releasing part 250*b* is pulled in the pulling direction A, the two movable ends 251 of the releasing part 250*b* are moved close to each other so that the distance between the two engaging portions 233 is decreased from d1 to distance d3. Since the releasing part 250*b* is an opened shaped structure, the releasing part 250*b* will be deformed when it is being pulled, and thereby increasing the space for the two connection parts 270*c* to be moved close to each other and reducing the effort on disengaging the male member 21*c*. For example, please refer to Table 2, which shows tests of pulling strength required in disengaging the male members based the configurations of the buckle in the first and the third embodiments. It is noted that the angle formed between the first sub-connection part and the second sub-connection part (the angles θ1 and the angle θ3) in these practical examples are the same, e.g. θ1=θ3=155 degrees.

TABLE 2

| first embodiment | | third embodiment | |
|---|---|---|---|
| angle (θ1 = 155°) | pulling strength | angle (θ3 = 155°) | pulling strength |
| Sample 1 | 2.1 (kg) | Sample 1 | 0.7 (kg) |
| Sample 2 | 2 (kg) | Sample 2 | 0.7 (kg) |
| Sample 3 | 2.2 (kg) | Sample 3 | 0.8 (kg) |
| Sample 4 | 2.1 (kg) | Sample 4 | 0.9 (kg) |
| Sample 5 | 1.9 (kg) | Sample 5 | 0.9 (kg) |

As shown in Table 2, the pulling strengths required in disengaging the male members in the samples of the buckles based on the third embodiment are less than that based on the first embodiment, so the opened shaped releasing part 250*b* is favorable for saving effort on unplugging the male member.

In addition, in the aforementioned embodiments, although each connection part is divided into the first sub-connection part and the second sub-connection part, but the present disclosure is not limited thereto. As shown in FIG. 8, a male member 21*d* is provided, and it includes two connection part 270*d*. Each connection part 270*d* is a straight structure and directly connected to the engaging portion 233 and the movable end 251 of the opened shaped releasing part 250*b*.

Figure 10:
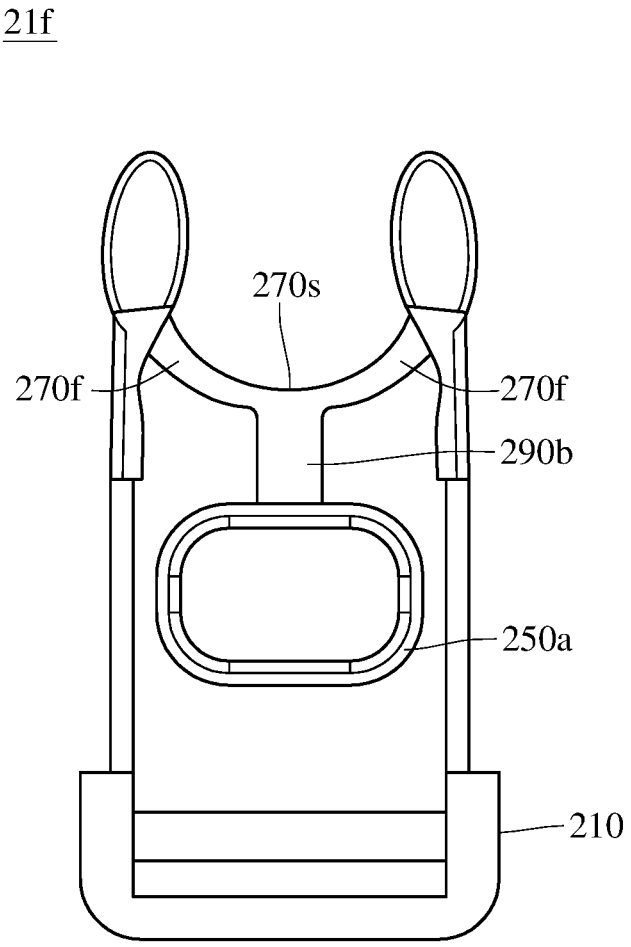
FIG. 10 is a top view of a male member of a sixth embodiment of the disclosure.
Figure 11:
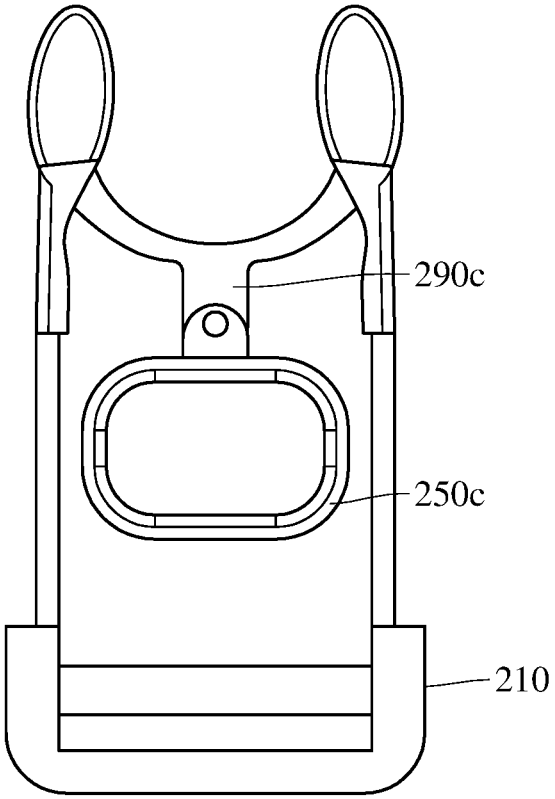
FIG. 11 is a top view of a male member of a seventh embodiment of the disclosure.
Figure 12:
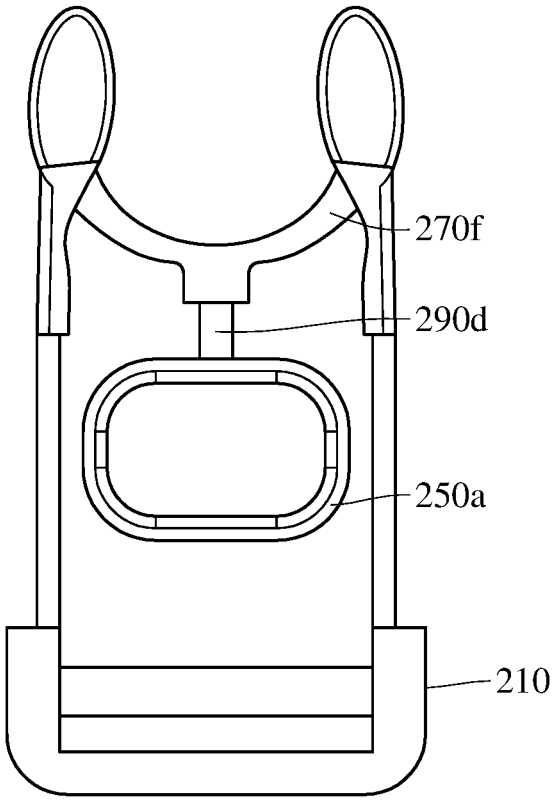
FIG. 12 is a top view of a male member of an eighth embodiment of the disclosure.

Then, in the aforementioned embodiments, the releasing part is connected to the two engaging parts through the two connection parts, but the present disclosure is not limited thereto. For example, please refer to FIG. 9A, FIG. 9B, FIG. 10, FIG. 11 and FIG. 13, FIG. 9A is a top view of a male member of a fifth embodiment of the disclosure, FIG. 9B is a top view of a releasing part of the male member in FIG. 9A moved with respect to a base part, FIG. 10 is a top view of a male member of a sixth embodiment of the disclosure, FIG. 11 is a top view of a male member of a seventh embodiment of the disclosure, and FIG. 12 is a top view of a male member of an eighth embodiment of the disclosure. In the following embodiments, only differences therebetween are explained because these embodiments are similar to one another.

Figure 9A:
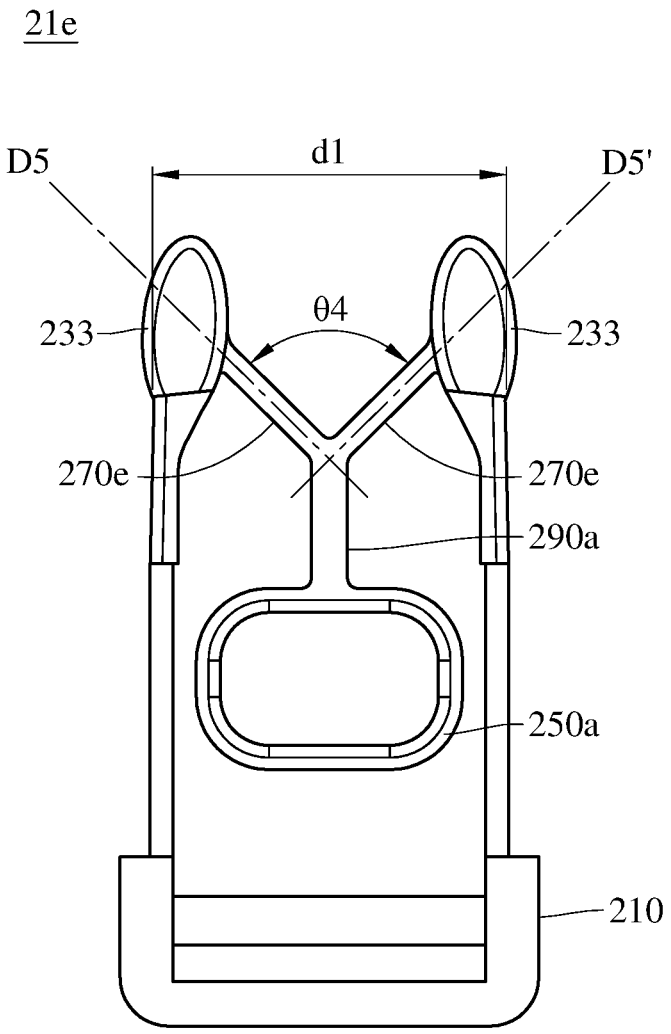
FIG. 9A is a top view of a male member of a fifth embodiment of the disclosure.
Figure 9B:
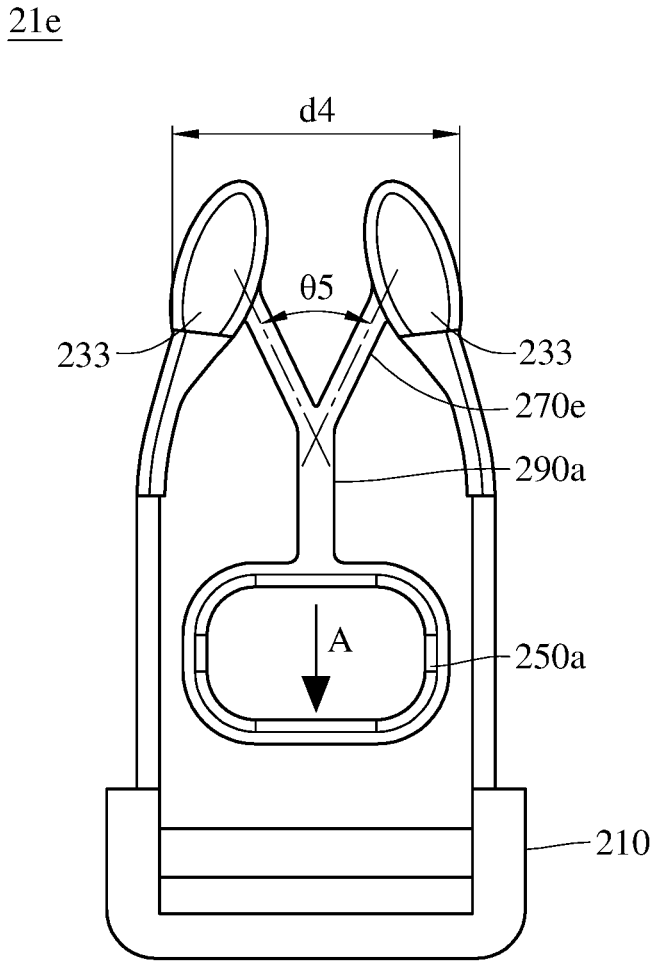
FIG. 9B is a top view of a releasing part of the male member in FIG. 9A moved with respect to a base part.

As shown in FIG. 9A, a male member 21*e* is provided, and it includes two connection parts 270*e* and an extension part 290*a*, the releasing part 250*a* is connected to the two connection parts 270*e* through the extension part 290*a*, the two connection parts 270*e* and the extension part 290*a* substantially form a Y-shaped structure. In details, the connection parts 270*a* respectively have an extension line D5 and D5', and an angle θ4 formed between the two extension lines D5 and D5' of the two connection parts 270*e* ranges between 30 degrees and 170 degrees. The engaging portions 233 in this embodiment are similar to that in the aforementioned embodiments, and the distance between the two engaging portions 233 is d1. Then, as shown in FIG. 9B, when the releasing part 250*a* is pulled in the direction A to move the two connection parts 270*e*, the angle between the two connection parts 270*e* is reduced from θ4 to θ5, and the distance between the two engaging portions 233 is reduced from d1 to distance d4.

Please refer to Table 3 in below, which shows operation tests of practical examples based on the configuration of the buckle in the fifth embodiment. It is noted that angles θ1 of these practical examples are different, but these practical examples are different in the connection parts, but the movement of each releasing part 250*a* while testing these practical examples are the same.

TABLE 3

| angle (θ4) | distance(d1) | distance(d4) | movement of the engaging portion ((d1-d4)/2) |
|---|---|---|---|
| 90° | 29.30 (mm) | 23.75 (mm) | 2.76 (mm) |
| 80° | 29.30 (mm) | 23.10 (mm) | 3.09 (mm) |
| 70° | 29.30 (mm) | 22.50 (mm) | 3.38 (mm) |
| 60° | 29.30 (mm) | 22.35 (mm) | 3.47 (mm) |
| 50° | 29.30 (mm) | 21.70 (mm) | 3.78 (mm) |

As shown in Table 3, if the angle θ4 between the two connection parts 270*e* is smaller, the movement of the engaging portion 233 is greater.

Then, as shown in FIG. 10, a male member 21*f* is provided, and it includes two connection parts 270*f* and an extension part 290*b*. The two connection parts 270*f* of the male member 21*f* are connected to form a continuously curved surface 270*s*. In the embodiments in FIG. 9A to FIG. 10, the extension part, the releasing part and the two connection parts are integrated into one piece, but the present disclosure is not limited thereto. For example, as shown in FIG. 11, a male member 21*g* is provided, and it includes an extension part 290*c* and a releasing part 250*c* which are two independent objects, and the extension part 290*c* is pivoted to the releasing part 250*c*. For another example, as shown in FIG. 12, a male member 21*h* is provided, and it includes an extension part 290*d*. The extension part 290*d*, the releasing part 250*a* and the connection parts 270*f* are independent objects, and the material of the extension part 290*d* is different from that of the releasing part 250*a* and the connection parts 270*f*, in this embodiment, the extension part 290*d* can be made of fabric or plastic.

Figure 13:
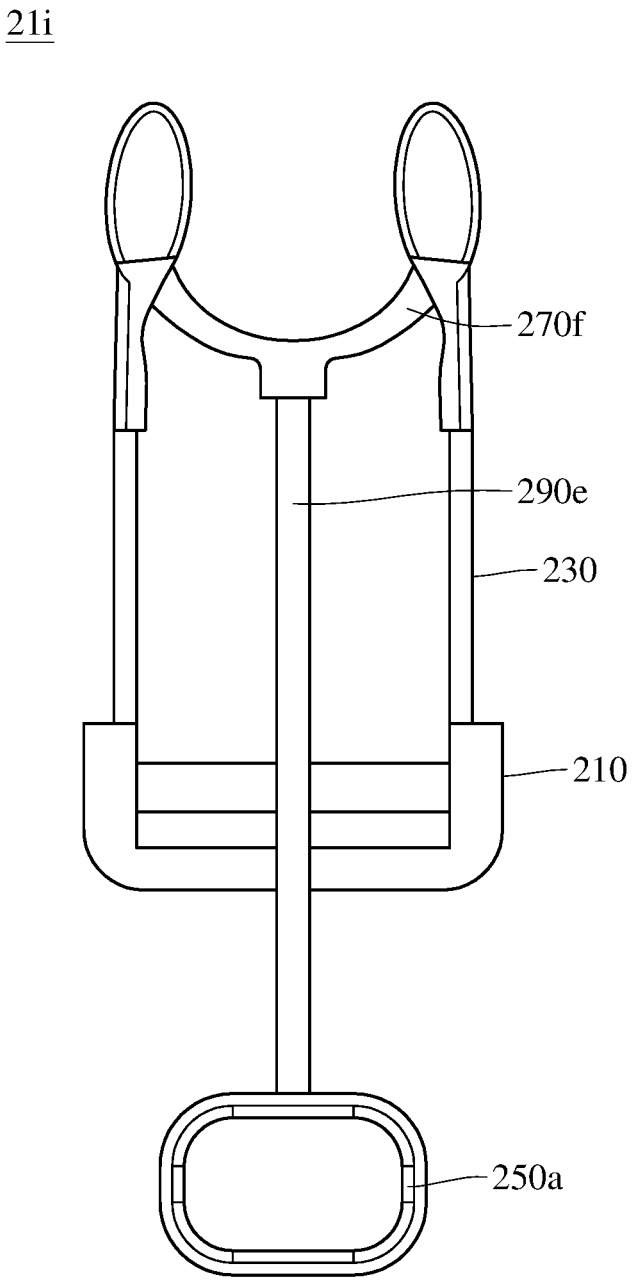
FIG. 13 is a top view of a male member of a ninth embodiment of the disclosure.

Then, in the aforementioned embodiments, the releasing part, the engaging parts and the connection parts are located at the same side of the base part, but the present disclosure is not limited thereto. For example, please refer to FIG. 13, which is a top view of a male member of a ninth embodiment of the disclosure. As shown in FIG. 13, a male member 21*i* is provided, and it includes an extension part 290*e*. The releasing part 250*a* is connected to the two connection parts 270*f* through the extension part 290*e*, the extension part 290*e* crosses the base part 210, and the base part 210 is located between the releasing part 250*a* and the connection parts 270*f*.

According to the buckle as discussed above, the two engaging parts of the male member can be disengaged from the side openings of the female member by moving the releasing part, so the buckle can be opened by using one hand or even one finger. Therefore, the operation of the buckle of the disclosure is easy and convenient for users.

In addition, the direction of moving the releasing part is substantially the same as the direction of unplugging the male member, so the movement and the disengagement can be finished in one action. Furthermore, the user can move their arm or body to help the pulling of the male member in order to reduce the effort on disengaging the male member from the female member. Therefore, the buckle of the disclosure is suitable for those infirm on their fingers.

Moreover, the buckle is opened by moving the releasing part, so the problem in the traditional buckles that user's finger is easily pinched while squeezing the movable tongues is prevented.

The embodiments were chosen and described in order to best explain the principles of the disclosure and its practical applications, to thereby enable others skilled in the art to best utilize the disclosure and various embodiments with various modifications as are suited to the particular use contemplated. It is intended that the scope of the disclosure be defined by the following claims and their equivalents.

What is claimed is:

1. A buckle, comprising:

a female member having a cavity and two side openings, the two side openings respectively located on two sides of the female member opposite to each other, and the two side openings connected to the cavity; and a male member partially detachably plugged into the cavity of the female member, the male member comprising a base part, two engaging parts and a releasing part, the two engaging parts disposed on the base part and located opposite to each other, the releasing part disposed between and connected to the two engaging parts, each of the engaging parts comprising an engaging portion and an arm portion, the arm portion located between and connected to the engaging portion and the base part;

wherein when the releasing part is moved with respect to the base part, the two engaging portions are moved close to each other by the movement of the releasing part so that the two engaging portions are respectively disengaged from the two side openings of the female member, wherein the releasing part comprises a through-hole sufficiently sized for a person's finger to pass there through.

2. The buckle according to claim 1, wherein the male member further comprises two connection parts located between and connected to the releasing part and the two engaging parts, and each of the two connection parts has an extension line, and an angle formed between the two extension lines of the two connection parts ranges between 30 degrees and 170 degrees.

3. The buckle according to claim 2, wherein the two connection parts of the male member is connected to form a continuously curved surface.

4. The buckle according to claim 2, wherein the releasing part of the male member has two movable ends and an opening located between the two movable ends, and the two movable ends are respectively connected to the two connection parts.

5. The buckle according to claim 2, wherein the male member further comprises an extension part located between and connected to the releasing part and the two connection parts, and the base part is located between the releasing part and the two engaging parts.

6. The buckle according to claim 1, wherein the male member further comprises two connection parts, each of the two connection parts comprises a first sub-connection part connected to the releasing part and a second sub-connection part located between and connected to the first sub-connection part and one of the engaging parts, and an angle formed between an extension line of the first sub-connection part and an extension line of the second sub-connection part ranges between 90 degrees and 180 degrees.

7. The buckle according to claim 6, wherein the releasing part of the male member has two movable ends and an opening located between the two movable ends, and the two movable ends are respectively connected to the two first sub-connection parts.

8. The buckle according to claim 6, wherein the two second sub-connection parts of the two connection parts are respectively pivoted to the two engaging parts.

9. The buckle according to claim 8, wherein the two first sub-connection parts of the two connection parts are pivoted to the releasing part.

10. The buckle according to claim 1, further comprising at least one cover detachably disposed on a side of the male member, the at least one cover having a guiding groove, and the releasing part of the male member movably located in the guiding groove.

* * * * *